United States Patent [19]

Geiger

[11] Patent Number: 4,720,019

[45] Date of Patent: Jan. 19, 1988

[54] CONTAINER CLOSURE WITH SEAL

[75] Inventor: Reinold Geiger, Neuilly, France

[73] Assignee: A.M.S. S.A., Saint-Ouen l'Aumone, France

[21] Appl. No.: 897,877

[22] Filed: Aug. 19, 1986

[30] Foreign Application Priority Data

Aug. 20, 1985 [FR] France ..... 85 12526

[51] Int. Cl.[4] ..... B65D 53/00

[52] U.S. Cl. ..... 215/343

[58] Field of Search ..... 215/343, 345, 350, 351, 215/DIG. 1

[56] References Cited

U.S. PATENT DOCUMENTS

| | | | |
|---|---|---|---|
| 1,962,875 | 6/1934 | Reber . | |
| 2,849,141 | 8/1958 | Abbiati et al. | 215/345 |
| 3,331,523 | 7/1967 | Exton | 215/350 |
| 4,238,042 | 12/1980 | Hatakeyoma et al. | 215/343 X |

FOREIGN PATENT DOCUMENTS

| | | | |
|---|---|---|---|
| 547660 | 5/1956 | Belgium . | |
| 484518 | 10/1929 | Fed. Rep. of Germany . | |
| 1017041 | 10/1957 | Fed. Rep. of Germany | 215/343 |
| 3025271 | 1/1981 | Fed. Rep. of Germany . | |
| 1389784 | 1/1965 | France | 215/343 |
| 1418477 | 10/1965 | France . | |
| 2006824 | 1/1970 | France . | |
| 746658 | 3/1956 | United Kingdom . | |
| 1066175 | 4/1967 | United Kingdom . | |

*Primary Examiner*—Donald F. Norton

*Attorney, Agent, or Firm*—Mason, Fenwick & Lawrence

[57] ABSTRACT

The invention relates to a stopper device for a container, in particular a container with a neck, consisting of a single-piece stopper with means for detachably joining the device to the container and to its neck, of single-piece sealing means with a seal or the like, and of means for joining the single-piece sealing means to the single-piece stopper, wherein the means (7) for joining the sealing means (5) to the stopper (2) are means which ensure a rigid and automatic connection, the sealing means (5) being rigidly joined to the stopper (2) by simple mounting of these sealing means (5) inside the stopper (2).

18 Claims, 4 Drawing Figures

CONTAINER CLOSURE WITH SEAL

The invention relates to a stopper device for a container, in particular a container with a neck, such as a phial, a bottle, etc., which ensures that this container is properly sealed once closed, and also to sealing means intended for such a stopper device.

Container stopper devices are already known, which have a stopper generally joined to the neck of the container in particular by means of threads and sealing means ensuring that the container is sealed when the stopper is screwed onto the neck. According to a first known embodiment, the stopper consists of a single piece, and the sealing means, which also consist of a single piece, are joined, for example crimped or glued, to the inside of the stopper. Thus, the material and the properties of the sealing means may be different from those of the stopper. For example, the seal is flexible and the stopper is rigid. However, in practice, manufacturing such a stopper device is fairly complex and costly and gives rise to problems, in particular as regards the method of joining the sealing means. In particular in the case where the sealing means have a tip-type seal, this seal must be perfectly centered in relation to the opening of the bottle. Moreover, the known joining methods are not entirely satisfactory. The glue may disintegrate under the action of the contents of the container or may give rise to a harmful reaction. Moreover, it is difficult to provide, at the bottom of the container, the crimping means or other mechanical means for joining the known stopper devices, thereby making the manufacture of these stopper devices too costly.

This is why preference is given to a second known embodiment of this stopper device which is made as a single piece and is, for example, molded. Sealing means are thus provided by giving a specific shape to the bottom of the stopper, as described for example in French Pat. No. 5,006,184. These stopper devices, however, have two drawbacks: on the one hand, since a single and same material is used to form the entire single-piece stopper device, it is difficult to make a sufficiently rigid stopper which can be firmly screwed onto the container, while having a sufficiently elastic seal; on the other hand, molding sealing lips on the bottom of the stopper is a delicate operation and these lips cannot always be applied properly against the container.

Belgian Pat. No. 547,660 describes a stopper device which has a flat removable seal having a connector piece force-fitted into a socket in the cap, joining being ensured by a spherical or toriadal enlargement which allows the seal to be freely rotated in relation to the cap. The cap directly assists in the sealing action, since the seal is applied against the bottle by the cap when the container is closed.

German Pat. No. 3,025,271 describes a stopper device with a cap which, itself, has a pin which penetrates inside a hole of a cylindrical stud which seals off the neck of the bottle exclusively on the inside. A device without a screw thread allows the cap to be fitted onto the neck. The problem which the present invention aims to overcome is to provide a stopper device which allows a non-cylindrical stopper to be fitted onto a phial. In principle, considerable deformation of the stud is not necessary in order to achieve a sealing effect. During deformation, there is the risk that the hole in the stud will not form an oval shape, thus affecting the grip of the cap stud. This drawback may be even greater, if the thinnest part of the stud is the part where the pin is located and the thickest part is the part cooperating with the neck.

British Pat. No. 1,066,175 describes a stopper device with a screw-type cap inside which an annular flange is provided so as to fix a flat seal by wedging a protruding part of this seal inside the annular flange. The cap helps ensure the sealing effect, the seal being applied against the cap when the container is closed.

German Pat. No. 484,518 describes a stopper device with an internal flange to which there is joined a gripping device, the end of which is frustoconical.

British Pat. No. 746,658 describes a seal with two lips, the upper external lip having a sealing rim, while the internal lip is substantially cylindrical. However, the thinnest part of this seal is in the center, which does not help ensure a sealed connection between the seal and the container. Moreover, a proper stopper is not associated with the seal. The cap provided for in this patent directly assists the sealing action, by matching the shape of the seal.

French Pat. No. 1,418,477 relates to a stopper device which comprises applicator which is interchangeable but may be glued to the cap.

Finally, U.S. Pat. No. 1,962,875 describes a stopper device with an applicator, the end of which for joining to the stopper cap comprises a chamfer and a shoulder.

The present invention aims to overcome the drawbacks of the present state of the art and proposes a stopper device of the type comprising a single-piece stopper and single-piece sealing means, which stopper is easy and inexpensive to manufacture and ensures perfectly tight closure of the container for which it is intended, the stopper being sufficiently rigid. Another aim of the invention is to provide a stopper device which can be applied to various types of container, in particular containers with a neck of any diameter, more particularly containers with a small diameter such as those used in perfumery and cosmetology.

The invention also relates to sealing means for a stopper device, consisting of a lip-type seal which may be applied to various types of bottles, whatever their external shape, and which also ensures perfect contact between the lips and the container, so as to achieve a better sealing effect.

For this purpose, a container stopper device according to the invention consists of a single-piece stopper comprising means for detachably joining the device to the container or its neck, and of single-piece sealing means which has a seal and which is joined to the single-piece stopper by a projection extending up wards from the central part of the seal and cooperating with a socket in the stopper extending downwardly. The projection has an upper part for joining the sealing means to the stopper by elastically engaging this upper part inside the socket and a cylindrical lower part for connecting the upper part and the seal. The means for joining the sealing means to the stopper are means which ensure a rigid automatic connection and which rigidly join the sealing means to the stopper by simple insertion of these sealing means inside the stopper.

The invention is applicable more particularly to containers with necks, such as the phials used in perfumery and cosmetology, where, firstly, the container must be perfectly sealed since the contents are volatile and must be protected from external agents, secondly, the shape of the stopper may be varied for aesthetic reasons which are of great importance in this sector and, thirdly, the dimensions of the container and more especially of the neck are quite small, in particular of the order of or of a few centimeters.

A stopper according to the invention is therefore both simple and inexpensive to manufacture since the sealing means are joined to the stopper in an automatic and particularly effective manner, in particular on account of the fact that different materials may be used for the stopper and the sealing means.

Other characteristic features and advantages of the invention will emerge upon reading the following description with reference to the attached drawings in which.

Figure 1:
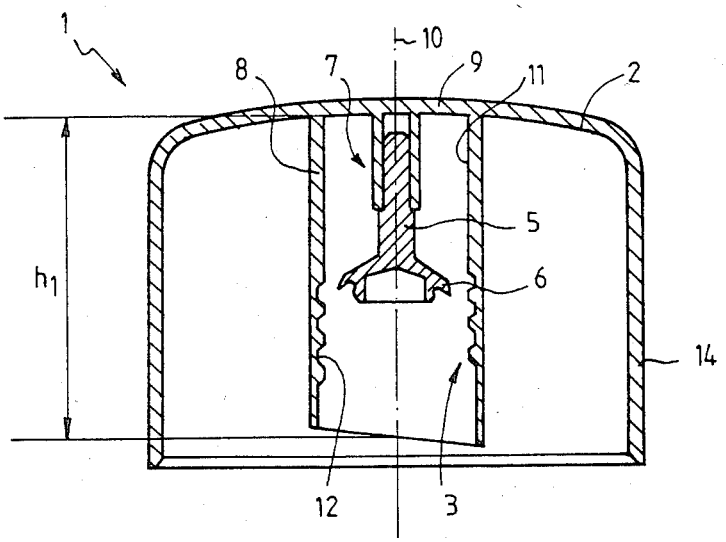
FIG. 1 is a longitudinal section of a stopper device according to the invention.
Figure 2:
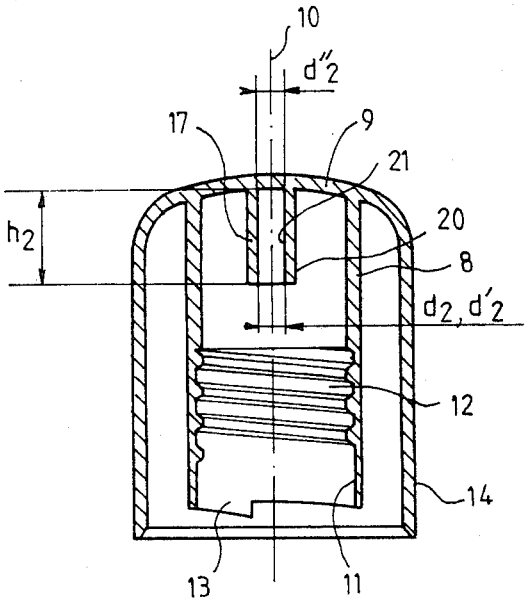
FIG. 2 is a cross-section of a single-piece stopper of a stopper device according to the invention.

A stopper device 1 according to the invention consists of a single-piece stopper 2 with means 3 for detachably joining the device 1 to the container 4 or to its neck (subsequently reference will only be made to a container), of single-piece sealing means 5 which are separate from the stopper 2 and have a seal 6, and of means 7 for joining the sealing means 5 to the stopper 2.

The container 4 is more especially a phial with a neck, used in pertumery and cosmetology, with the sealing action, shape and dimensions mentioned above.

In the description below, for the sake of greater clarity, reference will be made to the vertical direction, it being assumed that the container is a phial with a neck, arranged normally on a horizontal surface so that the neck and the opening are situated at the upper end of the phial, the stopper device being placed on top of the phial so as to close it. A person skilled in the art may adapt the invention to other applications. The terms "top", "bottom", "upper", "lower", "vertical" and "horizontal" relate to this vertical direction.

The stopper 2 has a skirt 8 which is closed at its upper end by an endpiece 9. The lower part at least of the skirt 8 forms a first part of the joining means 3, which cooperates with a second part located on the container. The skirt 8 has a substantially cylindrical shape of revolution about an axis 10 which coincides, when the stopper device 1 is in position on top of the container, with an axis of symmetry of the container 4. The axis 10 is also an axis of symmetry of the seal and, preferably, of the stopper 2, although this is not obligatory. In the preferred embodiment shown, the skirt 8 is substantially a hollow cylinder which is closed, at the top, by the endpiece 9 and the internal surface 11 of which has, in the vicinity of its lower part, an internal screw thread 12 capable of cooperating with a complementary thread on the container 4 so as to form the joining means 3. The lower end 13 of the skirt 8 has a suitable shape for cooperating with lugs or the like on the container 4, so as to form means for relative, in particular angular positioning of the device 1 in relation to the container 4 at the end of its screwing operation. These means for angular positioning allow a predetermined and constant tightening force to be exerted, while preventing damage to the joining means 3 and untimely reopening of the container 4. The joining means 3 may, however, be different from those described above, provided that they keep the device 1 on the container 4 by pressing the sealing means 5 against the container 4.

The skirt 8 is long in relation to its diameter, i.e. it extends a certain distance along the axis 10. For example, the axial height h1 of the skirt 8 is of the order of twice its diameter. The internal screw thread 12 also extends a certain axial distance, the turning action of screwing or unscrewing the stopper 2 onto/from the container 4 when the container 4 is closed or opened causing a certain amount of axial sliding of the stopper 2. The internal screw thread 12, i.e. the first joining part 3, occupies, notably, approximately the first lower half of the skirt 8. The seal 6 and the joining means 7 and hence the sealing means 5 are accommodated inside the second upper half of the skirt 8. Obviously the diameter of the main skirt 8 matches the diameter of the neck of the container 4.

Preferably, the stopper 2 also has a cap 14 forming a downwards extension of the endpiece 9 and surrounding externally the skirt 8. The cap 14 may have any desired shape and is of no direct importance for the invention, from an operational point of view; its function is to ensure a good grip for the user and an esthetic appearance.

The stopper 2 thus described is used for the following four functions: constituting a gripping means for the user; accommodating the seal 6 in general; transmitting the force created during tightening by the user to the seal 6 and, finally, ensuring a certain esthetic effect. On the other hand, the stopper 2 does not cooperate directly with the seal 6 to achieve a sealed closure. In particular and as is mentioned below, the stopper 2 does not act as an abutment for the seal 6 in the sealing position, i.e. in this position, the seal 6 does not have to be engaged by the stopper 2 and is "floating", even when the container is closed. It does not interfere directly with the endpiece 9 of the skirt 8 or the joining means 7', which are separated from the latter by the lower part 19 as discussed. Owing to this arrangement which makes the stopper 2 and the seal 6 independent as regards the sealing action, on the one hand an improved sealing effect is achieved, the seal 6 being positioned in the best possible position, and, on the other hand, the stopper 2 is able to perform a multipurpose function and may be used with different seals 6.

The means 7 for joining the sealing means 5 to the stopper 2 ensure an automatic rigid connection, the joining means 7 being joined to the stopper 2 by simply mounting these sealing means 5 inside the stopper 2. Preferably, these joining means are means for elastically engaging the sealing means 5 inside the stopper 2. The joining means 7 (see FIG. 5) consist of at least one projection 15 of the sealing means 5, extending upwards from the upper surface 16 of the seal 6, and of at least one socket 17 of the stopper 2 cooperating with the projection 15 so as to join the sealing means 5 rigidly to the stopper 2. The socket 17 is located inside the skirt 8 and extends downwards.

The skirt 8 constitutes means for guiding the sealing means 5, when it is introduced inside the stopper 2 or when the device 1 is placed on the container 4.

The projection 15 has an upper part 18 for joining the sealing means 5 to the stopper 2, with an axial height h5 less than or equal to the axial height h2 of the respective socket 17 into which it is introduced, and a cylindrical lower part 19 for connecting the upper part 18 and the seal 6, with an axial height h4.

The stopper 2 has a socket 17 which adjoins the endpiece 9 and is located inside the skirt 8 concentrically relative to the axis 10 and which has a radius smaller than that of the socket 8. At least the lower part 20 of the socket 17 is vertical and has a substantially symmetrical shape of revolution about the axis 10, the axial height h2 of the socket 17 being less than the axial height h1 of the main skirt 8. For example, the socket 17 has an axial height h2 of the order of a quarter of the axial height h1 of the skirt 8, the socket being located inside the upper half of the second (also upper) half of the skirt 8. The socket 17 is also long relative to its diameter, i.e. it extends a certain distance along the axis 10. For example, the axial height h2 of the socket 17 is of the order of twice its diameter.

The sealing means 5 have a projection 15, at least the upper part 18 of which is solid, vertical, has a substantially symmetrical shape of revolution about the axis 10 and radial external dimensions less than or equal to the internal radial dimensions of the socket 17, such that the upper part 18 is able to be introduced inside the socket 17 so as to join, rigidly and automatically, the sealing means 5 and the stopper 2.

The socket 17 has a slightly frusto-conical shape of revolution, its internal lower diameter d'2 being slightly greater than its internal upper diameter d''2. The upper part 18 of the projection 15 has a slightly frustoconical shape of revolution, its upper diameter d''3 being slightly less than its lower diameter d3, the internal upper diameter d''2 of the socket 17 being less than the upper diameter d''3 of the upper part 18 of the projection 15, so that when the upper part 18 of the projection 15 is introduced into the socket 17, the sealing means 5 and the stopper 2 are automatically and rigidly joined by means of elastic engagement.

The angle at the top of the cone defined by the socket 17 is slightly greater than the angle at the top of the cone defined by the upper part 18 of the projection 15. For example, d'2 and d'3 are approximately 3 mm, d''2 is approximately 2.7 mm, while d''3 is approximately 2.8 mm, for a height h3 of approximately 9 mm. Since d''3 is slightly greater than d''2, when the upper part 18 of the projection 15 of the socket 17 is introduced, elastic deformation of the socket 17 and/or of the projection 15 occurs, giving rise to a residual elastic engaging stress which enables the sealing means 5 to be rigidly and automatically joined to the socket 17 by means of static friction between the internal surface 21 of the socket 17 and the external surface 22 of the upper part 18 of the projection 15.

The materials used for the stopper 2 and the sealing means 5 are different: the stopper 2 is made of hard plastic and the sealing means 5 are made of more flexible plastic, both of which can be deformed locally whilst possessing a very good overall strength, for example molded or injected high density polyethylene and/or polypropylene. In this way, the projection is deformed more than the socket 17, during engagement.

The arrangement described is particularly effective and advantageous and, as an additional characteristic feature, the means ensuring a rigid and automatic joining action are detachable joining means, i.e. they allow the sealing means 5 to be subsequently detached from the stopper 2, without damaging these parts in any way. This may be useful, for example, for replacing the stopper 2 or the sealing means 5, for using different sealing means 5 with a stopper 2, etc.

By way of a variation, the internal surface 21 of the socket 17 has a cylindrical shape of revolution, with an internal diameter d2, and the upper part 18 of the projection 15 has a cylindrical shape of revolution, with an external diameter d3 similar to the diameter d2 such that it can be inserted into the socket 17. In this case, the diameter d3 is slightly greater than the diameter d2, rigid joining of the projection 15 and of the socket 17 being achieved by elastic engagement when the projection 15 is inserted into the secondary flange 17. However, the diameter d3 may also be less than or equal to the diameter d2, rigid joining being effected by gluing the internal surface 21 of the socket 17 to the external surface 22 of the projection.

This method of gluing is much more effective than the conventional method of gluing a seal to the bottom of a stopper. In fact, conventionally, the glued assembly would be subject to tensile and compressive stresses acting perpendicularly to the glued surfaces, while, in the case of the invention, the glued assembly is stressed in the shearing direction, parallel to the glued surfaces, thereby making it stronger.

Preferably, the lower part 19 of the projection 15 has substantially a cylindrical shape of revolution about the axis 10, with a diameter d4 greater than the lower diameter d'3 of the upper part 18 forming an extension thereof, such that the projection 15 has a stopping shoulder 23 at the junction between the upper part 18 and the lower part 19. This shoulder 23 limits axial insertion of the projection 15 into the socket 17 and transmits the force exterted by the user on the stopper 2 to the seal 6. This shoulder 23 may be in the form of a surface perpendicular to the axis 10, as shown in the Figures, but it may have any other suitable shape, with an abrupt change in the diameter.

In order to facilitate insertion of the projection 15 into the socket 17, the projection has preferentially, at its upper free end, a chamfer 24. As can be seen from FIG. 1, the sealing means 5 is accommodated entirely inside the skirt 8 and, in particular, inside the upper half. The upper part 18 has an axial height h3 sufficient to ensure that the sealing means 5 is tightly held inside the socket 17 of the stopper 2. The axial forces are transmitted by the stopper 2 to the sealing means 5 via the skirt 8 and the shoulder 23. Owing to the existence of a lower part 19 for connecting the upper fixing part 18 and the actual seal 6, the lower part 19 having a certain axial height h4 and a certain diameter d4 (the axial height h4 being, for example, of the order of half the axial height h3), the seal 6 can be separated from the endpiece 9 of the stopper 2 and the socket 17, even when the container is closed, the stopper 2 thus being independent of the seal 6 as regards the sealing effect in the sense that the stopper 2 does not directly urge the seal 6 against the container 4. The lower part 19 therefore allows the seal 6 to be mounted in "floating" fashion, i.e. permits slight radial movements, while also ensuring that forces transmitted between the stopper 2 and the sealing means 5 when the stopper 2 is screwed on in order to close the container. The seal 6 does not make contact with the skirt 8, the latter being located radially at a distance from the seal 6, however, this distance may be small in view of the shape of the container 4.

In the case of containers which have an opening with a large diameter (such as jars, tins, etc.) or when the need arises, the stopper 2 may have, by way of a variation, a plurality of sockets 17 arranged symmetrically about the axis 10. The sealing means 5 should have a plurality of projections 15 arranged in similar fashion, so that each projection 15 cooperates with a socket 17.

According to a second possible embodiment of the invention, the joining means 7 consist of at least one projection of the stopper 2 extending downwards from the endpiece 9, and of at least one socket of the sealing means 5 extending upwards from the upper surface 16 of the seal 6, the said socket cooperating rigidly with the said projection. This second embodiment is similar, in general, to the first embodiment described, except that the stopper 2 has the projection and the sealing means 5 have the corresponding socket.

The entire preceding description may be adapted to this second embodiment. In particular, the sealing means 5 no longer having a stopping shoulder, the endpiece 9 of the stopper limit insertion of the projection into the socket; the upper diameter of the flange is greater than the lower diameter of the projection and the lower diameter of the socket, while the upper diameter of the projection is greater than its lower diameter and similar to the upper diameter of the projection.

The seal 6 is a lip-type seal with an external sealing lip 25 intended to cooperate with the free horizontal upper surface 26 of the container, and an internal sealing lip 27 intended to cooperate with the internal and upper cylindrical wall 28 of the container 4, so as to ensure, in addition to the sealing action, centering of the seal 6 on the container 4. These two lips 25, 27 constitute two sealing barriers which ensure that the closed container is perfectly sealed.

Figure 3:
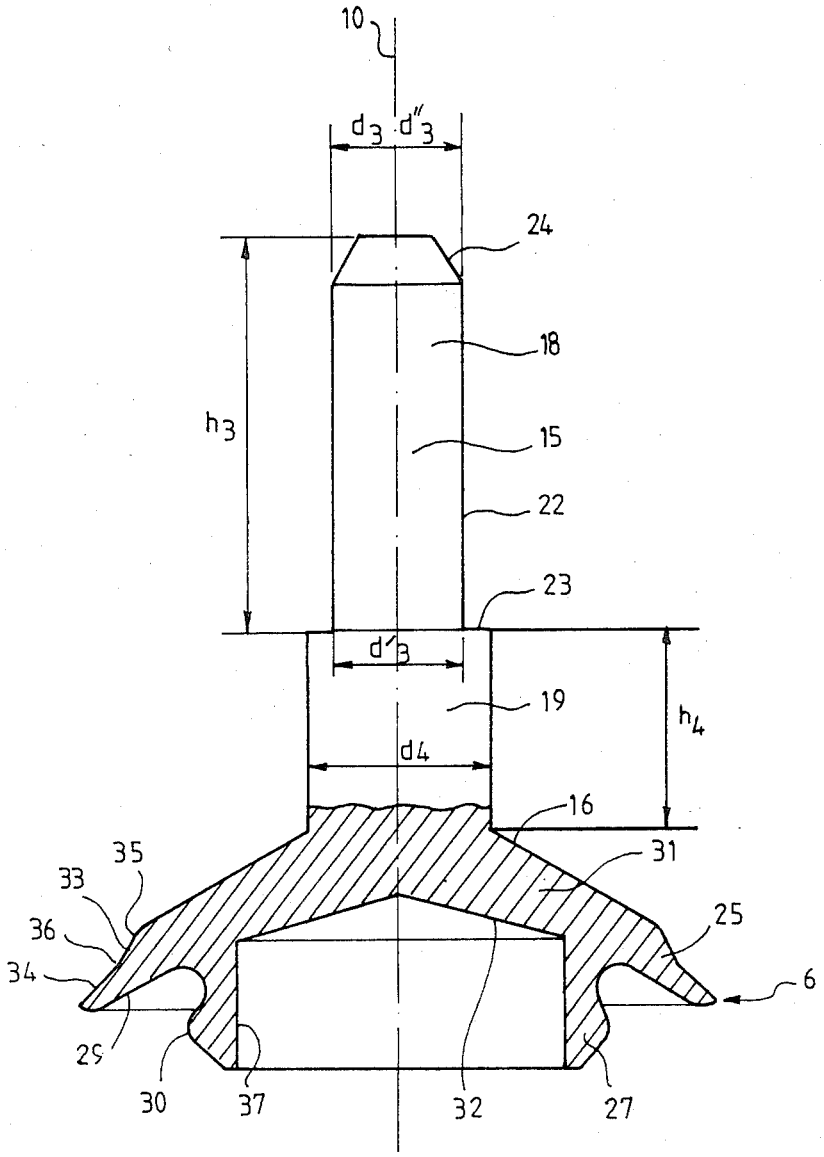
FIG. 3 is a section of the sealing means according to the invention in the rest condition, i.e. when they are not in contact with the container.

The external lip 25 has a symmetrical shape of revolution and its lower surface 29 is normally inclined relative to the horizontal, from the bottom upwards and from the outside towards the inside, i.e. upwards in the direction of the axis 10 (FIG. 3). The angle of inclination of the lower surface 29 in the rest condition is notably about 30° relative to the horizontal. Similarly, the internal lip 27 has a symmetrical shape of revolution and its external surface 30 is in the form of a substantially torridal sealing edge. When the stopper 2 is placed on the container 4, the thinner external lip 25 is compressed against the upper free surface 26 of the container 4, thereby tending to cause the internal lip 27 to pivot outwards and causing the sealing edge 30 to be compressed against the internal wall 28 of the container 4. Deformation of the external lip 25 therefore causes displacement of the internal lip 27 and deformation of the sealing edge 30 owing to the fact that the constituent material of the seal 6 can be elastically deformed locally and as a result of its overall strength and the shapes and thicknesses of the seal 6.

Figure 4:
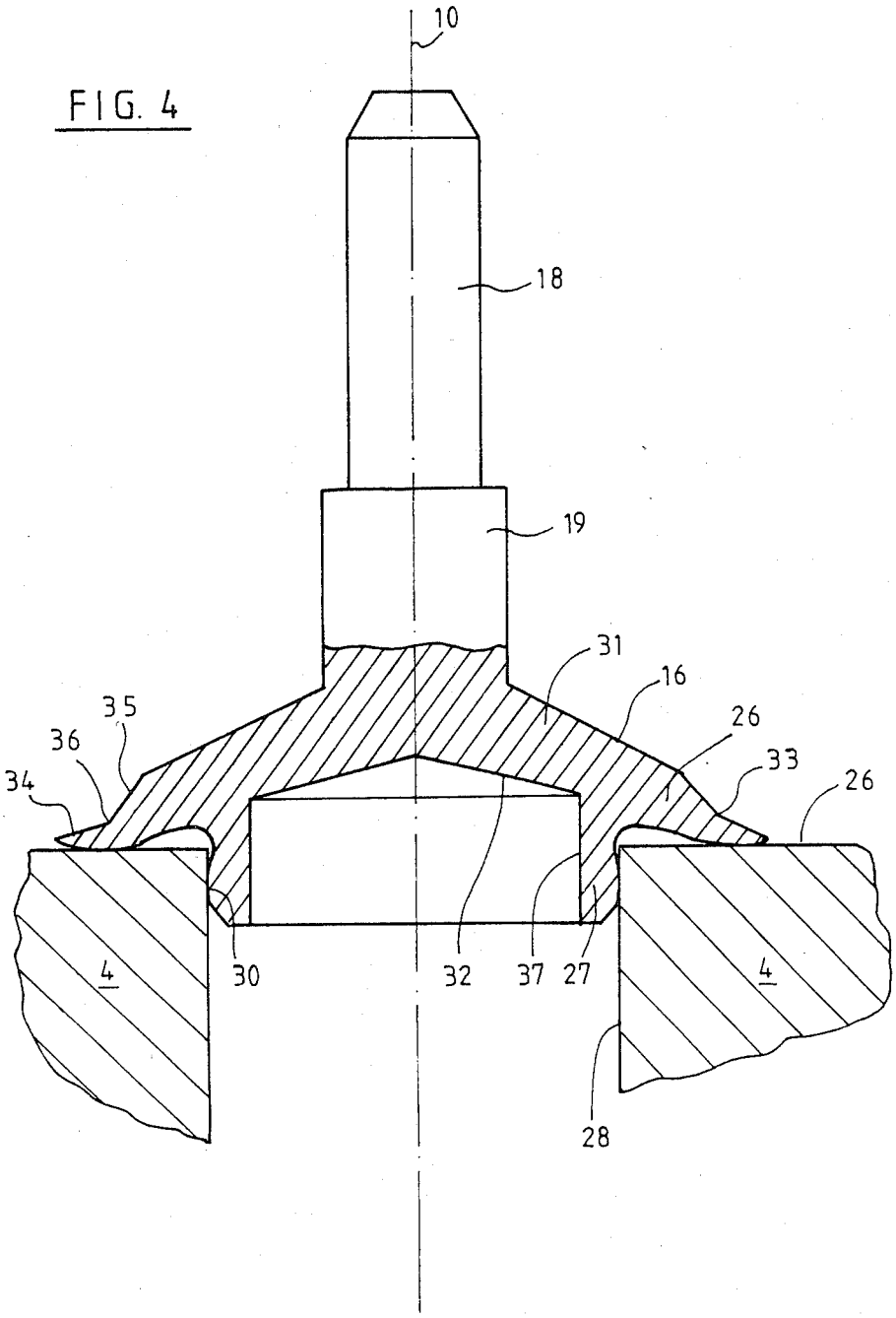
FIG. 4 is a partial section which shows the sealing means when the container is closed.

In order to facilitate compression of the sealing edge 30 against the internal wall 28 of the container 4, the central portion 31 of the seal 6 has a biconical shape of revolution, i.e. its upper surface 16 and lower surface 32 are trustoconical, the opening of the cones which they define being located near the bottom (FIGS. 3 and 4). The upper surface 16 is more inclined relative to the horizontal than the lower surface 32, the angles of inclination in the rest condition being in particular about 30° and 15° respectively. In other words, the angle at the top of the cone defined by the upper surface 16 is less than the angle at the top of the cone defined by the lower surface 32 and thickest part of the central portion 31 is located in the center along the axis 10. This thickness decreases outwards in the region where deformation is to take place. For example, in the unstressed condition, it is possible to define a median part of the central portion 31 consisting of the extension, downwards and in the central portion 31, of the lower part 19 as far as a horizontal plane perpendicular to the axis 10 passing through the top of the cone defined by the lower surface 32. In the unstressed condition, the external lip 25 forms substantially an extension, outwards, of the central portion 31. At its external end connected to the lips 25 and 26, the central portion 31 is thinner—on account of the biconicity described above—and forms a constriction separating the lips 25 and 27, this arrangement causing the lip 27 to be pivoted when the lip 25 is compressed.

When the device 1 is placed on the container 4, the central portion 31 is compressed slightly by the lower part 19 of the projection 15, thereby giving rise to an additional elastic stress which presses the sealing lips 25, 27 against the container 4. In order to ensure optimum transmission of the forces between the stopper 2 and the lips 25, 27, the lower part 19 occupies radially a considerable section of the central portion 31, for example of the order of 0.4 to 0.5 times the radius of the central portion 31. Moreover, the shoulder 23 facilitates this transmission of the forces.

The upper surface 33 of the external lip 25 has a first external part 34 which is more inclined relative to the horizontal than the lower surface 32, and a second part 35 for connecting the first part 34 to the upper surface 16, which is more inclined relative to the horizontal than the first part 34, so as to form a cleft 36 facilitating deformation of the external lip 25 when it is compressed, the angles of inclination in the rest condition being notably about 45° for the first part 34 and about 60° for the second part 35, relative to the horizontal.

The internal surface 37 of the internal lip 27 has, for example, notably a cylindrical shape of revolution, in line with the central zone of the upper surface 16, and joins the lower surface 32 substantially at the same level as the cleft 36 or the second part 35.

The free ends of the lips 25 and 27 are tapered, i.e. decrease in thickness towards their ends. The zone connecting the contact surfaces of the lips 25 and 26 (surface 29 for the lip 25 and external surface where the edge 30 is located, for the lip 27 is rounded.

The sealing means 5 consist, on the one hand, of the lip-type seal 6, notably with two sealing lips, an external lip 25 which has a symmetrical shape of revolution and a lower surface 29 inclined relative to the horizontal from the bottom upwards and from the outside inwards, notably at about 30° in the unstressed condition, and which is intended to cooperate with the upper free surface 26 of the container 4, and an internal lip 27 which has a symmetrical shape of revolution and a surface 30 in the form of a sealing edge and is intended to cooperate with the internal cylindrical wall 28 of the container 4, the seal 6 having a central portion 31 with a biconical shape of revolution, the upper surface 16 of which is more inclined relative to the horizontal than its lower surface 32, the angles of inclination in the instressed condition being notably 30° and 15°, respectively; and, on the other hand, of an axial projection 15 consisting of a lower part 19 which has a cylindrical shape of revolution about the axis 10 and forms an upwards extension of the central portion 31, and of an upper part 18 with a notably slightly frustoconical shape of revolution about the axis 10, a lower external diameter d'3 less than the diameter d4 of the lower part 19 of which it forms an upwards extension, so that the tightening effect which enables the stopper device 1 to be attached to the container causes, on the one hand, rigid joining of the sealing means 5 to the stopper 2 by means of elastic engagement of the projection 15 of the socket 17 of the stopper 2 an d, on the other hand, elastic compression of the central portion 31 of the seal 6 via the lower part 19 and also elastic compression of the sealing lips 25, 27 against the container 4, in particular compression of the external lip 25 against the upper free surface 26 of the container 4, thereby tending to displace the internal lip 27 outwards and compress its sealing edge 30 against the internal wall 28 of the container 4 or its neck.

By way of a variation, the seal 6 may have only one sealing lip 25 intended to cooperate with the upper free surface 26 of the container 4, notably when the opening of the container does not allow the internal lip 27 to penetrate inside the neck. In this case, the lip 25 may have any suitable shape which allows the container to be sealed by means of compression of this lip 25. Also by way of a variation, the seal 6 is not a lip-type seal, but a simple flat seal or the like which ensures a sealing effect by means of compression against the container 4 or its neck.

The above description of the preferred embodiments of the invention is in no way limiting and numerous variations which fall within the scope of the invention and which are apparent to a person skilled in the art are possible.

I claim:

1. A stopper for a container comprising:

means for detachably joining the stopper to a container, a seal for engaging a container, means for joining the seal to the stopper comprising a projection extending upwardly from the central portion of the seal and having an upper part thereof and a lower part joining the upper part to the seal, said joining means further comprising a socket extending downwardly from and within the stopper, said upper part of said projection being in said socket, means for securing said projection in said socket, said means resisting relative rotational and longitudinal movement of said projection relative to said socket, said stopper comprising an end piece at its upper end and said seal being spaced from said end piece by said lower part of said projection when said stopper is on a container and said seal is seated on the lip of a container, said stopper being free of parts located radially outwardly of the seal which would inhibit radial displacement of the seal when urged against the lip of a container and free of parts engaging the upper surface of said seal outwardly of said projection.

2. A stopper in accordance with claim 1, wherein said means for detachably joining the stopper to the container comprises a skirt depending from said end piece in surrounding relationship to said socket, said skirt extending downwardly a greater extent than said socket, said skirt having internal screw threads for joining the stopper to a threaded portion of a container, said socket and said sealing means being within said skirt and above the bottom edge thereof.

3. A stopper in accordance with claim 1, wherein said securing means comprises at least one of said projection and socket being elastically deformable and elastically deformed by the other of said projection and socket.

4. A stopper in accordance with claim 1, said securing means comprising glue between the exterior surface of said projection and the interior surface of said socket.

5. A stopper in accordance with claim 1, wherein said seal is generally transverse of the axis of said stopper, the projection upper and lower parts are each substantially cylindrical and symmetrical with the axis of the seal, the diameter of the upper part being smaller than the diameter of the lower part to thereby provide a shoulder, the height of the upper part being not greater than the height of the socket, the lower edge of the socket engaging said shoulder for limiting the insertion of the upper part of the projection into said socket and for transmitting forces from said stopper through said socket to said projection and to said seal.

6. A stopper in accordance with claim 1, said projection having an upper free end, said upper free end being chamferred to facilitate insertion of the upper part of said projection into said socket.

7. A stopper in accordance with claim 1, said seal having a peripherally extending and downwardly facing sealing lip for seating on the lip of a container surrounding an opening thereinto, said seal further having an internal sealing lip extending downwardly from said external sealing lip and having a sealing surface which extends circumferentially about the axis of said seal for engagement with the internal cylindrical wall of the opening of the container.

8. A stopper in accordance with claim 7, wherein said external lip has a symmetrical shape of revolution and an internal surface outwardly and downwardly inclined to the horizontal at an angle of approximately 30° in the unstressed condition of said seal, said internal lip having a symmetrical shape of revolution and an external surface defining a sealing edge for engagement with the interior wall of a container, said seal comprising means for causing said internal sealing lip to be urged outwardly when said external sealing lip engages the lip of a container and a force is applied to said external sealing lip to urge it against the lip of a container.

9. A stopper in accordance with claim 8, said seal having a lower surface inwardly of said internal lip, having an upper surface of the external lip with a first external part, and radially inwardly thereof a second part, said first external part being more inclined to the horizontal than said lower surface, said second part being more inclined to the horizontal than said first part, a cleft between said parts of said surface for facilitating deformation of the external lip when said lip is compressed against the lip of a container, the angles of inclination of said first and second parts of said surface in the unstressed condition of said seal being approximately 45° and 60°, respectively.

10. A stopper in accordance with claim 7, wherein said seal central portion has a biconical shape of revolution, the upper surface thereof being more inclined relative to the horizontal than the lower surface thereof, the angles of inclination of said central portion upper and lower surfaces in the unstressed condition being approximately 30° and 15°, respectively, whereby when a force is applied to said seal by said projection, an additional elastic force will be effected for pressing said internal and external lips against the container.

11. A stopper in accordance with claim 1, wherein the internal surface of said socket has a frustoconical shape of revolution with the lower internal diameter thereof being slightly greater than the upper internal diameter thereof, said upper part of said projection having a frustoconical shape of revolution with its upper diameter being slightly less than the lower diameter thereof, the lower diameter of said projection being substantially equal to the lower internal diameter of said socket, the upper internal diameter of said socket being less than the diameter of the upper part of said projection.

12. A stopper in accordance with claim 1, wherein said socket has an internal surface of cylindrical shape, and wherein the upper part of the projection has a cylindrical shape with an external diameter substantially the same as the internal diameter of said socket.

13. A stopper in accordance with claim 1, wherein the central portion of said seal is thicker than the peripheral portions thereof, the thickness of said seal decreasing radially outwardly.

14. A stopper for a container comprising:

means for detachably joining the stopper to a container, a seal for engaging a container, means for joining the seal to the stopper comprising a projection extending from one said element and a socket carried by the other said element, a part of said projection being in said socket, means for securing said projection in said socket, said means resisting relative rotational and longitudinal movement of said projection relative to said socket, said stopper comprising an end piece at its upper end and said seal being spaced from said end piece by said projection when said stopper is on a container and said seal is seated on the lip of the container, said stopper being free of parts located radially outwardly of the seal which would inhibit radial displacement of the seal when urged against the lip of a container and free of parts engaging the upper surface of said seal outwardly of said projection.

15. A stopper for a container comprising:

means for detachably joining the stopper to a container, said stopper comprising an end piece at its upper end, a seal for engaging a container, means for joining the seal to the stopper with the seal spaced from said end piece, said stopper being free of parts located radially outwardly of the seal which would inhibit radial displacement of the seal when urged against the lip of a container and free of parts engaging the upper surface of said seal outwardly of said projection, said seal having a peripherally extending and downwardly facing sealing lip for seating on the lip of a container surrounding an opening thereinto, said sael further having an internal sealing lip extending downwardly from said external sealing lip and having a sealing surface which extends circumferentially about the axis of said seal for engagement with the internal cylindrical wall of the opening of the container.

16. A stopper in accordance with claim 15, wherein said external lip has a symmetrical shape of revolution and an internal surface outwardly and downwardly inclined to the horizontal at an angle of approximately 30° in the unstressed condition of said seal, said internal lip having a symmetrical shape of revolution and an external surface defining a sealing edge for engagement with the interior wall of a container, said seal comprising means for causing said internal sealing lip to be urged outwardly when said external sealing lip engages the lip of a container and a force is applied to said external sealing lip to urge it against the lip of a container.

17. A stopper in accordance with claim 16, said seal having a lower surface inwardly of said internal lip, having an upper surface of the external lip with a first external part, and radially inwardly thereof a second part, said first external part being more inclined to the horizontal than said lower surface, said second part being more inclined to the horizontal than said first part, a cleft between said parts of said surface for facilitating deformation of the external lip when said lip is compressed against the lip of a container, the angles of inclination of said first and second parts of said surface in the unstressed condition of said seal being approximately 45° and 60°, respectively.

18. A stopper in accordance with claim 15, wherein said seal central portion has a biconical shape of revolution, the upper surface thereof being more inclined relative to the horizontal than the lower surface thereof, the angles of inclination of said central portion upper and lower surfaces in the unstressed condition being approximately 30° and 15°, respectively, whereby when a downward force is applied to said seal, an additional elastic force will be effected for pressing said internal and external lips against the container.

* * * * *